US005959229A

United States Patent [19]

Walley

[11] Patent Number: 5,959,229

[45] Date of Patent: Sep. 28, 1999

[54] STROBE TUNER FOR MUSICAL INSTRUMENTS WITH MULTIPLE LIGHT SOURCES

[76] Inventor: David Collin Walley, 102 Acadia Bay, Winnipeg, Canada

[21] Appl. No.: 09/013,882

[22] Filed: Jan. 26, 1998

[51] Int. Cl.[6] ..... G10G 7/02

[52] U.S. Cl. ..... 84/454; 84/455; 84/477 R; 84/484; 84/485 R

[58] Field of Search ..... 84/454, 455, 477 R, 84/485 R, 484

[56] References Cited

U.S. PATENT DOCUMENTS

| | | | |
|---|---|---|---|
| 3,861,266 | 1/1975 | Whitaker . | |
| 4,061,071 | 12/1977 | Cameron . | |
| 4,365,537 | 12/1982 | Pogoda . | |
| 5,637,820 | 6/1997 | Wittman | 84/454 |

*Primary Examiner*—William M. Shoop, Jr.
*Assistant Examiner*—Kim Lockett
*Attorney, Agent, or Firm*—Adrian D. Battison; Murray E. Thrift

[57] ABSTRACT

A tuning device for a stringed musical instrument consisting of stroboscopic light sources, such as light emitting diodes (LEDs), positioned to be seen by a musician in or near normal playing position as partially eclipsed by the strings. The LEDs are driven at standard musical frequencies by a microprocessor. To use the device, a musician observes the illusion of a moving shadow around an untuned vibrating string, and adjusts the instrument until the shadow appears to slow down and stop. The LEDs are sufficiently powerful, and their duty cycles are sufficiently large, that no special shielding or means of observation are required by the musician in normal ambient lighting conditions. A plurality of LEDs is grouped behind each string, with each LED in the group having the same frequency but different phase, which creates an illusion of movement along the string in one direction or the other indicating whether the string is sharp or flat. A single microprocessor may be used to time and control all of the LEDs of such a device by using a simple and efficient algorithm to calculate phases from a plurality of accumulating sums.

20 Claims, 3 Drawing Sheets

STROBE TUNER FOR MUSICAL INSTRUMENTS WITH MULTIPLE LIGHT SOURCES

The present invention is directed toward a device for tuning musical instruments and more particularly to an electronic stroboscopic device for tuning stringed musical instruments.

BACKGROUND OF THE INVENTION

Numerous electronic tuning devices have been proposed for aiding a musician in the tuning of a musical instrument. In operation, these devices generally fall into three broad categories.

Devices in the first category use a microphone, pick-up, or other transducer to convert an acoustic tone from a musical instrument into an electrical signal which is analysed using various means, ultimately displaying with a meter or other electronic display, whether the tone is sharp, flat, or in tune. Examples of this type of device include U.S. Pat. Nos. 3,631,756 issued to Mackworth-Young in May 1968; 4,028,985 issued to Merritt in June 1977; 4,688,464 issued to Gibson in August 1987; and 5,637,820 issued to Wittman in June 1997.

Devices in the second category use a transducer to convert an acoustic tone into an electrical signal which modulates the overall perceived brightness of a display, such as a rotating painted disk or a circle of light emitting diodes (LEDs), which rotates, flashes, or otherwise changes in a periodic manner at the frequency of a desired tone. The well-known stroboscopic effect creates an illusion to the human eye of movement of the display which appears to slow down and stop as the instrument is brought into tune. Examples of this type of device include U.S. Pat. Nos. 3,861,266 issued to Whitaker on Jan. 21, 1975; 3,952,625 issued to Peterson on Feb. 18, 1975; 5,016,515 issued to Scott on May 21, 1991; and 4,252,048 issued to Pogoda on Feb. 24, 1981.

The above devices in the first and second category suffer from the use of a transducer or input from a transducer. A transducer adds complexity and expense. In addition, many of the designs recognize that extraneous noise and other errors in the input signal are problematic. In most devices, the musician must take care to sound only one string at a time while tuning.

In the third category, the devices have the advantage that they do not use a transducer, but rely instead on the directly observable physical vibration of the vibrating part of a musical instrument, such as the string of a guitar. Stroboscopic illumination is used to slow down and stop the apparent vibration as the instrument is brought into tune. U.S. Pat. No. 3,385,153, issued to England on May 28, 1968, disclosed specially located frets to adjust to the frame speed of a television receiver. U.S. Pat. No. 4,061,071 issued to Cameron on Dec. 6, 1977 disclosed a stroboscopic tuning device that includes a housing whereby strings to be tuned are observed through a slot in the housing. U.S. Pat. No. 4,335,642, issued to Pogoda on Jun. 22, 1982, disclosed illumination with a monochromatic stroboscopic light source and viewing through a filter of the same color. U.S. Pat. No. 4,365,537, issued to Pogoda on Dec. 28, 1982, disclosed a strobe light held in the hand so as to shine on a vibrating string.

To maintain accuracy of tuning, the existing devices employ various means of generating accurate reference frequencies. Quartz crystal oscillator circuits are commonly used to generate a highly accurate base frequency which is divided to close approximations of the equal tempered scale with frequency divider circuits.

However the above devices in the third category have not achieved commercial success and all have some disadvantage which appears to have prevented commercial acceptance. Thus the device of England is inconvenient if a television receiver is not at hand so that this device is impractical even if it is technically viable.

Other existing devices in the third category suffer from difficulty of observation due to low perceived strobe light intensities relative to interfering ambient lighting conditions. Observing reflected light is particularly problematic and Pogoda, in various patents, finds it necessary to use lenses or filters or to electronically simulate a string's vibration to enhance the strobe effect. Without discussion of its advantages, Cameron employs a better method which is, not to rely solely on reflected light, but to position the strobe light source behind the string so that some of the light travels directly from the source to the eye. Nevertheless, because short pulses of strobe light are employed, overall perceived intensity is low and Cameron finds it necessary to use a housing to shield the string from ambient light.

Existing devices in the third category do not provide an indication of whether a string is sharp or flat, only that a string is in tune or not.

Electronically generating standard musical frequencies presents a problem which is not satisfactorily resolved in existing designs. In particular, the equal tempered musical scale is based on irrational numbers. For example, in the equal tempered scale, B has a frequency of 246.94165 which in England's preferred embodiment is approximated as 247.5. Whitaker and Peterson use frequency divider circuits to approximate desired musical frequencies. Scott recognizes the inaccuracy of divider circuits and provides a solution which uses a shift register clocked by a microprocessor implementing a software delay algorithm, but this scheme is complicated and requires considerable programming effort and expertise to implement even the single desired frequency as described.

SUMMARY OF THE INVENTION

It is one object of the present invention to provide an improved method of tuning a musical instrument of the type having at least one and generally more strings which are individually tunable by tension changes to predetermined required frequencies of vibration.

According to a first aspect of the invention there is provided a method of tuning a musical instrument having at least one string tunable by changing tension therein by a player of the instrument comprising:

providing a source of stroboscopic light;

locating the source relative to the string such that rays of light from the source shines directly past the string into the eyes of the player such that some of said rays are eclipsed by the string;

driving said stroboscopic light source at a frequency equal to a required frequency of vibration of the string;

observing movement of a shadow on the light source caused by a difference in frequency between an actual frequency of the string and the required frequency;

and changing tension in the string so as to slow the movement of the shadow to cause tuning of the string to the required frequency;

the light source, the string and the eyes being arranged so that the area between the string and the eyes is open from shielding to allow the entry into the area of ambient light whereby the string and the source are observed without the need for shielding.

Preferably the light source is driven with sufficient power and sufficiently large duty cycle that the player perceives the stroboscopic light source to be bright in normal ambient lighting conditions without shielding or means of observation.

Preferably this is achieved by controlling the driving of the light source such that the frequency of the light source has a duty cycle which is greater than 10% and more preferably in the range 10% to 25%.

Preferably the method includes providing a plurality of stroboscopic light sources in a row along the string and driving the light sources with the same frequency but differing in phase. Where the phases are selected such that each light source along the row follows in phase the previous source on the row, this provides a wave effect in the shadow along the string in a direction which varies depending upon whether the string is sharp or flat.

Preferably the instrument has a plurality of strings and wherein there is provided a plurality of stroboscopic light sources each driven at a frequency equal to a required frequency of vibration of a respective one of the strings and wherein each is positioned relative to the instrument to be partially eclipsed by the respective string when viewed from a common position.

Preferably the light sources are mounted on the instrument in fixed position relative thereto.

Preferably the light sources are mounted on a common support in fixed position thereon such that the common support can be located on the instrument for location of the light sources at required positions relative to the respective strings.

Preferably the common support comprises a circuit board and wherein the circuit board also carries components for driving the light sources.

Preferably the light sources are driven by an electronic circuit consisting primarily of a microprocessor where the microprocessor is controlled by a program which provides for the source a train of pulses having a frequency which is accurate when averaged over a plurality of cycles but for which start and finish times of the pulses are variable.

In the arrangement including a plurality of stroboscopic light sources in a row along the string, the microprocessor executes an algorithm consisting primarily of a single, repeating, infinite loop wherein accumulating sums are used to calculate current phases for different frequencies, which in turn determine the illumination pattern of corresponding groups of said stroboscopic lights.

Preferably the required frequency can be selected and changed by the player as an input to the microprocessor.

According to a second aspect of the invention there is provided a method of tuning a musical instrument having at least one string tunable by changing tension therein by a player of the instrument comprising:

providing a source of stroboscopic light;

locating the source relative to the string such that rays of light from the source shine directly past the string into the eyes of the player such that some of said rays are eclipsed by the string;

driving said stroboscopic light source at a frequency equal to a required frequency of vibration of the string;

observing movement of a shadow on the light source caused by a difference in frequency between an actual frequency of the string and the required frequency;

and changing tension in the string so as to slow the movement of the shadow to cause tuning of the string to the required frequency;

and providing a plurality of stroboscopic light sources in a row along the string and driving the light sources with the same frequency but differing in phase.

According to a third aspect of the invention there is provided a method of tuning a musical instrument having a plurality of strings each tunable by changing tension therein by a player of the instrument comprising:

providing a plurality of sources of stroboscopic light each associated with a respective one of the strings;

locating each source relative to the respective string such that rays of light from the source shine directly past the string into the eyes of the player such that some of said rays are eclipsed by the string;

driving said stroboscopic light sources each at a frequency equal to a required frequency of vibration of the respective string;

observing movement of a shadow on the light source caused by a difference in frequency between an actual frequency of the string and the required frequency;

and changing tension in the string so as to slow the movement of the shadow to cause tuning of the string to the required frequency;

wherein the light sources are mounted on a common support in fixed position thereon such that the common support can be located on the instrument for location of the light sources at required positions relative to the respective strings.

According to a fourth aspect of the invention there is provided a method of tuning a musical instrument having at least one string tunable by changing tension therein by a player of the instrument comprising:

providing a source of stroboscopic light;

locating the source relative to the string such that rays of light from the source shine directly past the string into the eyes of the player such that some of said rays are eclipsed by the string;

driving said stroboscopic light source at a frequency equal to a required frequency of vibration of the string;

observing movement of a shadow on the light source caused by a difference in frequency between an actual frequency of the string and the required frequency;

and changing tension in the string so as to slow the movement of the shadow to cause tuning of the string to the required frequency;

wherein the light source is mounted at a position offset to one side of a position symmetrically beneath the string so as to be viewed from a playing position offset to one side of the string.

In general, therefore, light sources, such as light emitting diodes (LEDs), are located behind the strings as seen by the musician in or near a normal playing position. An LED behind a given string flashes at the desired musical frequency for the string. The vibrating string eclipses a portion of the flashing LED, which creates a stroboscopic illusion of a moving shadow around an untuned string. The musician adjusts the vibrating string until said shadow slows down and stops, at which time the string is in tune. Each LED is bright, and its duty cycle is large compared to conventional strobe devices, thereby allowing use in normal ambient lighting conditions without special shielding, filtering, or magnifying means.

Furthermore, a plurality of LEDs are grouped behind a string, each LED with the same desired frequency, but out of phase relative to each other. This creates the illusion of shadow movement along the string's length. Movement is in one direction if the string is sharp, and in the other direction if the string is flat. Furthermore, such a group of LEDs is provided for each string of the instrument.

All of a device's many LEDs may be controlled and driven by a single microprocessor running at moderate speed. The microprocessor is able to control all of the LEDs by employing an efficient algorithm which maintains extremely high accuracy of long-term frequencies by sacrificing the precision of features of the LED driver waveforms which are not critical to the stroboscopic effect and utility of the present invention.

The embodiment of the present invention as described in detail hereinafter has the following advantages over existing tuning devices:

1. No transducer or transducer input is required, which represents a reduction in complexity, size, and expense over other devices, as well as eliminating potential errors from extra circuitry and extraneous ambient noise, as well as eliminating any connection to, and potential interference with, sensitive audio circuitry which the musician may also be using.

2. The device uses the stroboscopic effect which many musicians recognize as a superior tuning method.

3. The device employs light travelling directly to the eye from stroboscopic light sources with high apparent brightness, so that no special shielding, filter, nor magnification is required for the musician to use the device from a normal position in normal ambient lighting conditions.

4. The device uses a simple, efficient, and very precise software algorithm capable of servicing a plurality of different frequency timer waveform outputs, allowing very accurate tuning.

5. The tuning of all strings of an instrument can be checked simultaneously.

6. The device is compact enough to be mounted on an instrument without interfering with playing, thereby always being conveniently at hand.

7. The electronic circuitry is simple and inexpensive.

DETAILED DESCRIPTION OF THE INVENTION

Figure 1:
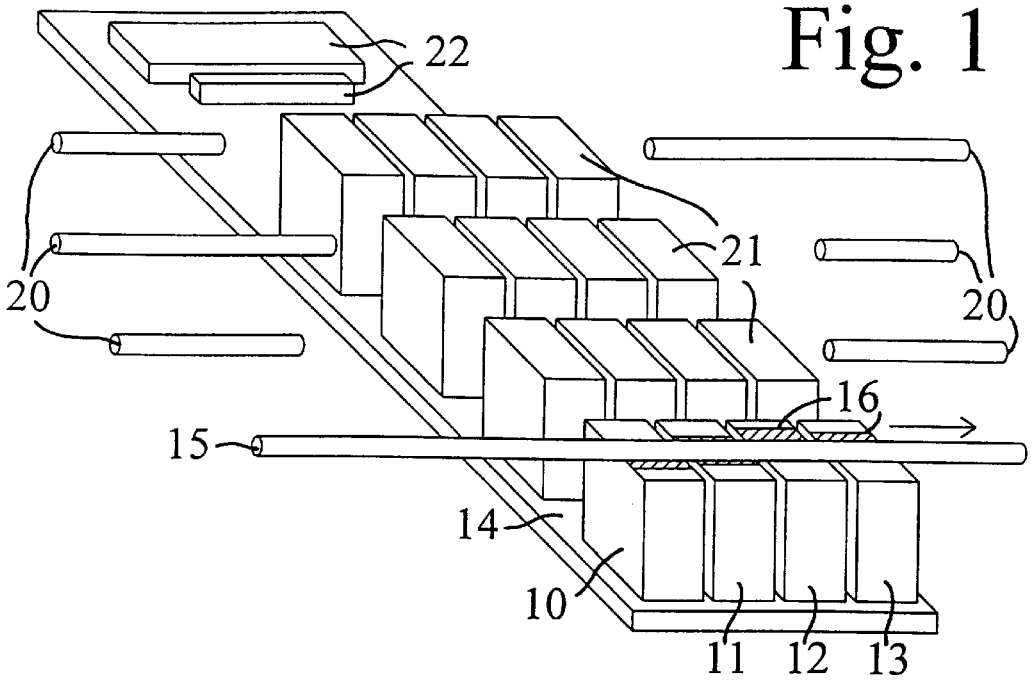
FIG. 1 is an isometric view of a stroboscopic tuner for a stringed musical instrument embodying the present invention. In particular, the tuner is for an instrument with four strings such as a bass guitar, and the view is as a musician would see the tuner from the normal playing position.
Figure 2:
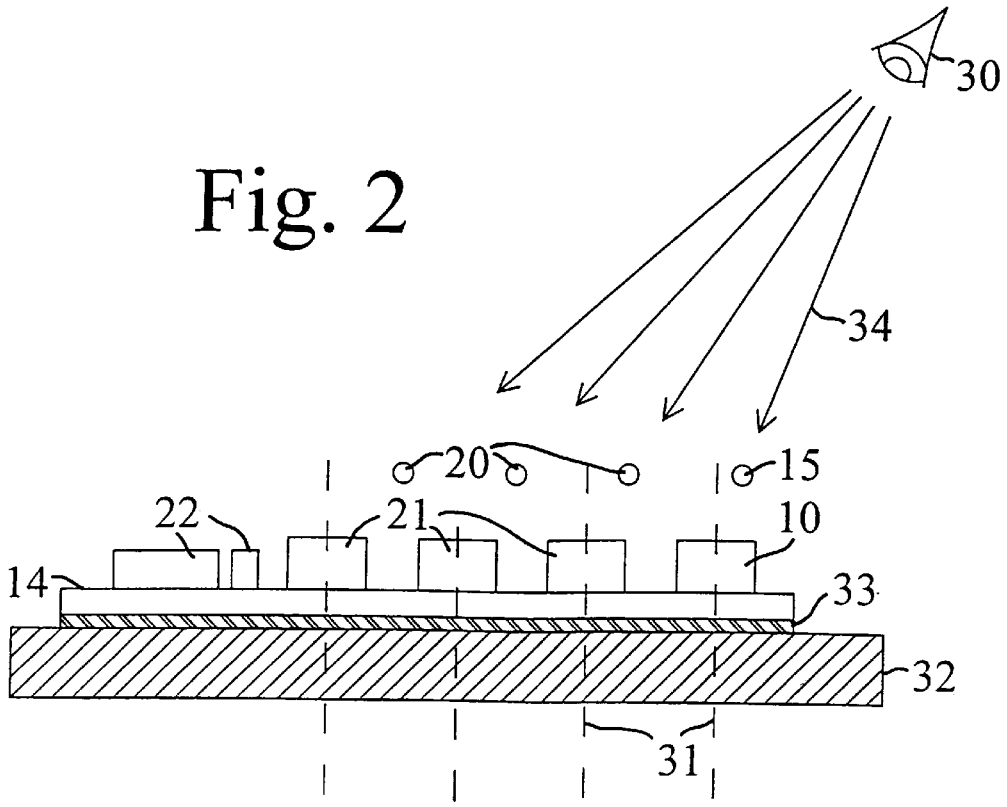
FIG. 2 is an end elevational view showing the positioning of the tuner relative to the strings of the instrument.

Illustrated in FIGS. 1 and 2 is the preferred embodiment of a stroboscopic tuner for a four stringed musical instrument, such as an electric bass guitar. LEDs 10, 11, 12, and 13, are mounted on a printed circuit board 14, and fit under a string 15. Referring to FIG. 2, there is enough clearance between the string 15 and LEDs 10, 11, 12, and 13, such that there is never contact or other interference. Furthermore, the tuner is positioned as shown in FIG. 2 so that the LEDs 10, 11, 12, and 13 will be seen as being behind the string 15 by a musician in or near a normal playing position 30. The area above the LEDs and underneath the strings is open and free from shielding which could interfere with normal playing of the instrument with the device in place. The area between the strings and the playing position or observation point is also free from shielding or the necessity for special observation techniques such as lenses. The player can therefore simply directly observe the light sources and the strings above the light sources. As the playing position is often offset from a line 31 directly above the light source, the light source is mounted on the circuit board and the circuit board is mounted on the instrument 32 by adhesive or similar 33 at a position so that the string is offset to one side of the center line 31 to lie on a line 34 between the light source and the observation position.

LEDs 10, 11, 12, and 13 flash with a frequency equal to the desired musical frequency of the string 15. The eye perceives uniform and constant illumination, except of course where the string 15 eclipses and obscures the light. To tune the string 15, the musician plucks the string so that it vibrates. The musician perceives the illusion of a shadow, as indicated by the shaded area 16, where the string repeatedly eclipses the light when the LEDs 10, 11, 12, and 13 are on. According to the well known stroboscopic effect, this perceived shadow 16 will move slowly and stop as the string 15 is tuned to the same frequency as the LEDs 10, 11, 12, and 13.

Figure 3:
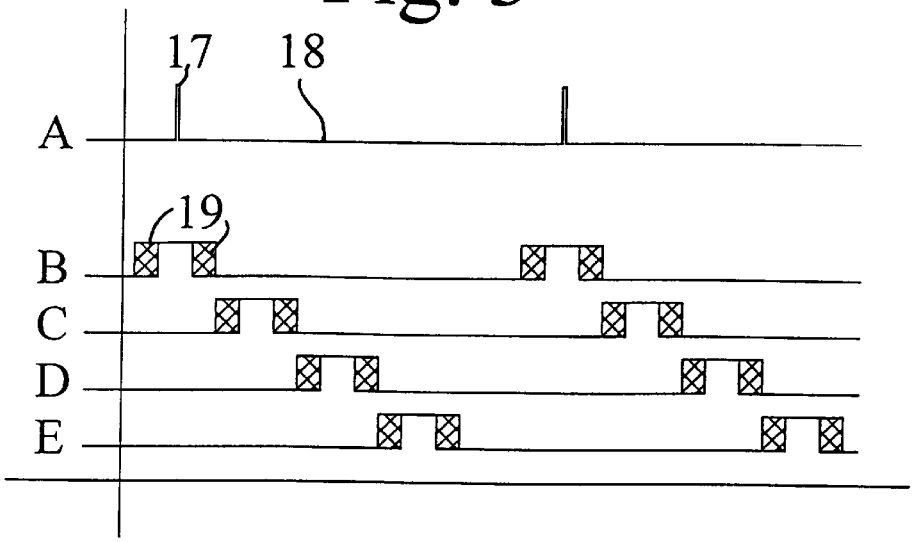
FIG. 3 is a graph, with time extending along the horizontal axis, of light intensity waveforms used in the preferred embodiment of the present invention, and for purposes of comparison, a waveform of a conventional stroboscopic light source.

Referring to FIG. 3, waveform A shows the timing of the illumination of a conventional stroboscopic light source. In particular, waveform A shows that a conventional stroboscopic light source is on for a very short period of time 17, relative to the period of time 18 when it is off. Said another way, the duty cycle of a conventional strobe light is small. Conventional stroboscopic light sources use small duty cycles to produce sharply focussed stroboscopic images.

Waveform B shows the timing of the illumination of LED 10. Shaded areas 19 indicate possible errors, that is, the state of illumination during time periods indicated by shaded areas 19 is not precisely known. This error or uncertainty is accepted as a consequence of the algorithm used for generating the signals as described in more detail hereinafter. Also, waveform B has a duty cycle much larger than that of a conventional strobe light, so LED 10 appears bright in normal ambient lighting conditions. As a result, the perceived shadow 16 is not sharply focussed. However, experimentation shows that errors of the type represented by the shaded area 19, and large duty cycles of greater than 10% and preferably in the range 10% to 25%, do not detract from the overall utility and accuracy of the present invention.

Waveforms B, C, D, and E show the timing of the illumination of LEDs 10, 11, 12, and 13 respectively, and in particular, that they have the same frequency but are out of phase with respect to each other, that is the waveform for each LED in the row of LEDs along the string is arranged to be delayed relative to that of the next previous LED in the row. Referring again to FIG. 1, as a result of these phase differences the perceived shadow 16 appears to take the rough shape of a wave. Also, if the string 15 is flat, the musician will perceive the illusion that the waveshaped shadow 16 moves along the string 15 in the direction indicated by the arrow. If string 15 is sharp instead, the shadow 16 appears to move in the opposite direction, thereby allowing the musician to know which way to adjust the instrument.

The other strings 20, have corresponding groups or rows of LEDs 21 with the necessary frequencies selected to match the required frequency of the respective string as is well known to one skilled in the art. This feature allows all the strings 15 and 20, to be tuned independently and checked simultaneously.

Printed circuit board 14 extends beyond the strings 20 to support the electronic timing and driving circuit. FIG. 1 is suggestive only of various components 22, which are specified in detail in FIG. 4.

Figure 4:
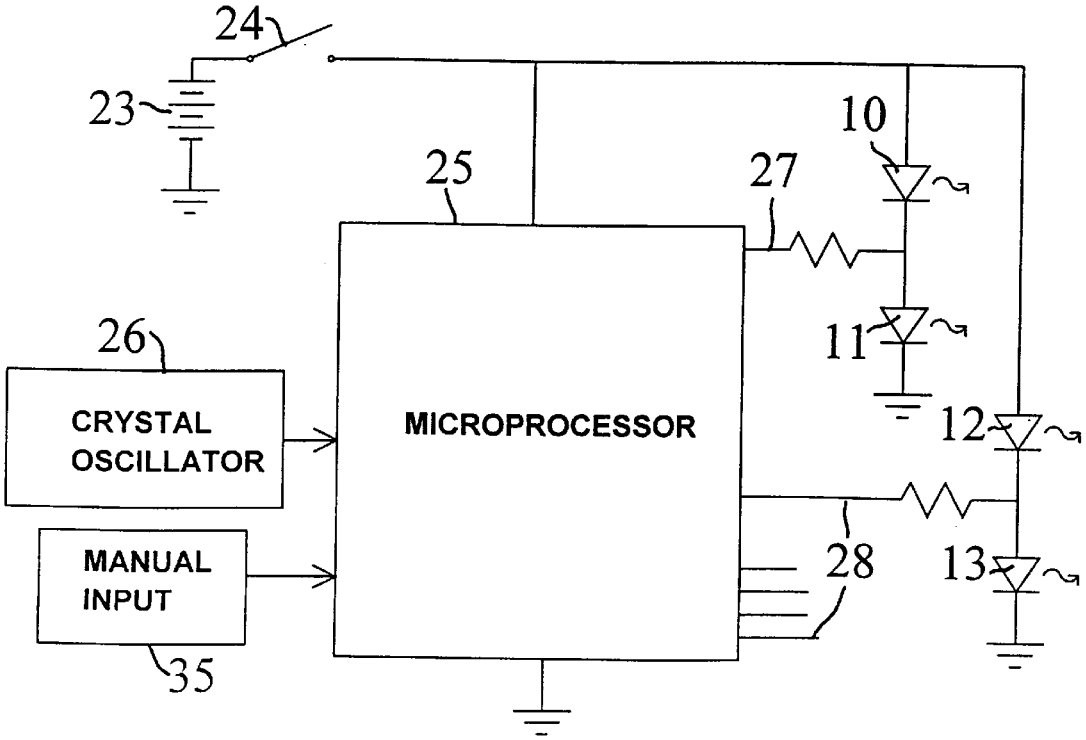
FIG. 4 is a schematic block diagram of the electronic circuitry of the preferred embodiment of the present invention.

FIG. 4 shows an electronic schematic and block diagram for the preferred embodiment. A 3 Volt battery 23 provides power through switch 24, to a microprocessor 25, which is preferably a PIC16C84 manufactured by Microchip Technology Inc. The overall timing of the microprocessor is controlled by a quartz crystal oscillator circuit 26, as specified in the data sheets for the PIC16C84, which provides a stable and very accurate reference frequency of 10 MHz.

A manual input 35 allows the player to program the microprocessor to select required frequencies for the strings for different tunings as are well known.

The microprocessor 25 features tri-state input/output pin 27. When pin 27 is configured by software as an output low state, current is drawn in and LED 10 will turn on. When pin 27 is an output high state, current is supplied to LED 11 and it will turn on. When pin 27 is configured as a high impedance input, no current flows, and since turning on LEDs 10 and 11 require more than about 1.7 Volts separately or 3.4 Volts in series, battery 23 is not sufficient to illuminate either LED 10 or LED 11.

Using identical circuitry, other input/output pins 28 control other LEDs such as LEDs 12, 13, and others which are not shown in FIG. 4 for reasons of clarity.

The software to generate waveforms B, C, D, and E, and similar waveforms of other frequencies for other LED groups 21, employs an optimized algorithm. The algorithm is simple and efficient, and is capable of generating a plurality of timing waveforms with different frequencies and phases while maintaining extremely high accuracy as measured over the long term, all generated by the single microprocessor 25. Referring again to FIG. 3, the algorithm achieves this by sacrificing precise, short term timing as indicated by the shaded areas 19.

Figure 5:
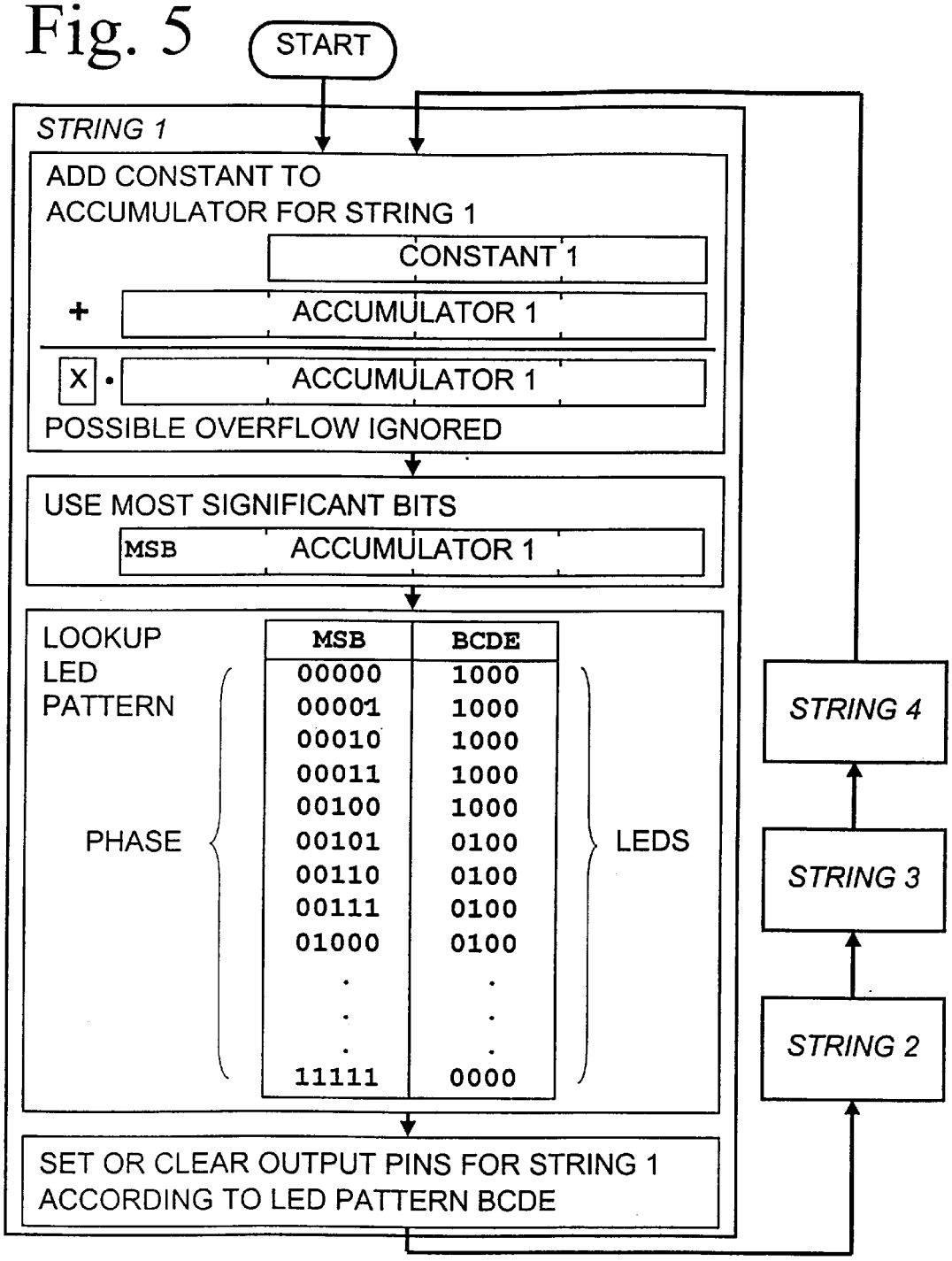
FIG. 5 is a schematic layout of the algorithm by which the waveforms are calculated.

A schematic of the algorithm is shown is in FIG. 5. In general the micro processor includes a memory having a look up table which indicates for each string the required status of the light sources at a series of pre-determined times throughout a cycle of calculation. Thus, in a situation where there are four light sources for each string, at selected times during the calculation cycle each light source should be on while the others are off.

Furthermore, in general the microprocessor acts to calculate from the look up table the required status for each string sequentially in turn.

Each string is also associated with an accumulator system into which a constant number is repeatedly added. The constant number for each string is determined by calculating the ratio of the total length of time of the complete loop which is necessary for effecting the calculations for all the strings relative to the time period between required pulses for that particular string.

As the status of the lights for each string is calculated sequentially and repeatedly, the necessary result of this technique is that the start times for the pulses of each light source are necessarily and are generally not at exactly the required frequency. Furthermore the stop times for the pulses are similarly generally not at the required frequency. However over a significant number of pulses, the average frequency for the pulses is equal to the required frequency. The situation is shown in FIG. 3 where the start and stop time of the pulses can vary.

This technique allows the use of a single microprocessor to effect the necessary calculations for all of the strings.

The algorithm is as follows:

1. For each string in turn and its corresponding frequency, add a corresponding multiple byte constant to an existing multiple byte accumulating sum for that string, ignoring overflows of the accumulating sum;
2. Use the most significant bits of the accumulating sum to look-up in a look-up table, the required pattern of illumination for LEDs 10, 11, 12, and 13. The accumulated sum is compared with the look-up table and the pattern which corresponds to the nearest entry in the table is selected and implemented for the sources of that string. In the preferred embodiment, 5 bits are used with a table of 32 entries corresponding to 32 divisions of one cycle of waveforms B, C, D, and E;
3. Repeat the above procedure for each of the other strings 20 to implement a pattern for the other groups of LEDs 21, using the relevant constant for that string and the relevant accumulating sum;
4. Repeat the above in a free-running infinite loop such that the pattern for each string is repeatedly calculated a number of times within the cycle time for the required string frequencies.

Care must be taken while programming to ensure that all branches which may be taken will require the same time of execution so that the loop time remains accurately constant.

The constant used for the addition in the accumulator for each strings is chosen so that the accumulating sums overflow, on average over the long term, at the desired musical frequency for that string, and is calculated from ratio of the cycle time of the desired musical frequency of the string relative to the time required to implement one loop of the entire procedure. The constants will depend upon the execution speed of the microprocessor 25. The precision of the accumulating sums and constants should be better than the accuracy of other elements of the tuner to ensure the inherent error of approximation is insignificant to overall accuracy of the device. In the preferred embodiment, the accumulating sums are 32 bits long, and 4 constants for the four frequencies of the standard equal tempered tuning for a bass guitar are pre-calculated to 24 or more significant bits of precision and stored in read only memory (ROM).

The preferred embodiment for bass guitar as described is but one embodiment of the present invention.

Alternate embodiments of the present invention may be designed for other stringed instruments such as a six stringed guitar, violin, piano, and the like.

The device may be mounted inside a housing, such as a molded plastic case, or it may be encased in a poured resin such as epoxy. The device may be hand-held, built-in to a new instrument, or temporarily or permanently attached to an instrument in various ways. Alternate embodiments may locate and mount components of the circuitry, such as the switch and battery, separately and in various ways.

Mirrors, other reflective surfaces, or light pipes may be employed so that LEDs do not have to be under the strings. However the light from the LEDs is supplied to a position so that it is directed past the string to the eye of the player.

The frequencies and timing waveforms of the LEDs need not be exactly as implemented in the preferred embodiment and may be altered to provide different patterns of the apparent shadow. For example, a string may be more conveniently tuned to a harmonic of the fundamental frequency of the LEDs, such as in the case of a twelve string guitar where some adjacent strings differ by an octave. Patterns of illumination can be altered from the illumination pattern of the preferred embodiment, which could be described as a saw tooth sweep pattern, to a sine wave back-and-forth pattern, which will result in shadows tracing approximations of the well-known Lissajous figures.

Light sources other than LEDs may be used. Bi-color LEDs where two or more colors flash out of phase with respect to each other may be employed to enhance the shadow and provide additional or alternate indication of whether a string is sharp or flat.

Alternate embodiments may implement the electronic circuitry and software in various ways using various fabrication techniques. Different numbers of LEDs per string may be employed, from one LED per string or per device in the case where power or space requirements are restrictive, to many LEDs per string where the shape of the shadow is to be enhanced. Alternate timing circuits, microprocessors, and driving circuits may be used. A momentary action switch may be employed to re-activate the microprocessor from a sleep state.

Alternate embodiments may use different desired frequencies. Rather than storing constants in ROM as in the preferred embodiment, the device may be programmable to any desired tunings, scales, or frequencies under software control through a wide variety of means including but not limited to buttons, a key-pad, a remote control for selecting notes, or direct connection to a computer or network for musical instruments (MIDI).

Alternate embodiments may control the LEDs to provide feedback to the musician about frequencies selected, or to add other features such as a metronome. Alternate embodiments may employ a speaker or audio output signal to provide audible reference tones.

Alternate embodiments may provide for the modulation of the LEDs by an audio input signal, rather than a standard frequency, so that an instrument can be tuned to the non-standard frequency of another instrument or a recording.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A method of tuning a musical instrument having at least one string tunable by changing tension therein by a player of the instrument comprising:

providing a source of stroboscopic light;

locating the source relative to the string such that rays of light from the source shine past the string into the eyes of the player such that some of said rays are eclipsed by the string;

driving said stroboscopic light source at a frequency equal to a required frequency of vibration of the string;

observing movement of a shadow on the light source caused by a difference in frequency between an actual frequency of the string and the required frequency;

and changing tension in the string so as to slow the movement of the shadow to cause tuning of the string to the required frequency;

the light source, the string and the eyes being arranged so that the area between the string and the eyes is open from shielding to allow the entry into the area of ambient light whereby the string and the source are observed without the need for shielding.

2. The method according to claim 1 wherein the light source is driven with sufficient power and sufficiently large duty cycle that the player perceives the stroboscopic light source to be bright in normal ambient lighting conditions without shielding or means of observation.

3. The method according to claim 1 wherein the frequency of the light source has a duty cycle which is greater than 10%.

4. The method according to claim 3 wherein the duty cycle is in the range 10% to 25%.

5. The method according to claim 1 including providing a plurality of stroboscopic light sources in a row along the string and driving the light sources with the same frequency but differing in phase.

6. The method according to claim 5 wherein the phases are selected such that each light source along the row follows in phase the previous source on the row.

7. The method according to claim 1 wherein the instrument has a plurality of strings and wherein there is provided a plurality of stroboscopic light sources each driven at a frequency equal to a required frequency of vibration of a respective one of the strings and wherein each is positioned relative to the instrument to be partially eclipsed by the respective string when viewed from a common position.

8. The method according to claim 7 wherein the light sources are mounted on the instrument in fixed position relative thereto and directly behind the respective string.

9. The method according to claim 7 wherein the light sources are mounted on a common support in fixed position thereon such that the common support can be located on the instrument for location of the light sources at required positions relative to the respective strings.

10. The method according to claim 9 wherein the common support comprises a circuit board and wherein the circuit board also carries components for driving the light sources.

11. The method according to claim 1 for use with an instrument having a plurality of strings wherein there is provided a plurality of light sources each being arranged for co-operation with a respective one of the strings, wherein the light sources are each driven at a required frequency by an electronic circuit consisting primarily of a microprocessor and wherein the microprocessor is arranged to determine a required status of each light source sequentially in turn.

12. The method according to claim 11 wherein the microprocessor is controlled by an algorithm which provides for each source a train of pulses having a frequency which is accurate when averaged over a plurality of cycles but for which start and finish times of the pulses are variable.

13. The method according to claim 11 including providing for each string a plurality of stroboscopic light sources in a row along the string and driving the light sources with the same frequency but differing in phase wherein said microprocessor executes an algorithm consisting primarily of a single, repeating, infinite loop wherein accumulating sums are used to calculate current phases for different frequencies, which in turn determine the illumination pattern of the row of said stroboscopic lights.

14. The method according to claim 1 wherein the required frequency can be selected and changed by the player.

15. The method according to claim 1 wherein the instrument has a surface underneath the string over which the string vibrates and wherein the light source is mounted in fixed position on the surface.

16. The method according to claim 1 wherein the light source is mounted behind the string at a position offset to one side of a position symmetrically beneath the string so as to be viewed from a playing position offset to one side of the string.

17. The method according to claim 16 wherein the instrument has a plurality of strings, wherein there is provided a plurality of stroboscopic light sources each driven at a frequency equal to a required frequency of vibration of a respective one of the strings and wherein each is positioned relative to the instrument to be partially eclipsed by the respective string when viewed from the playing position.

18. A method of tuning a musical instrument having at least one string tunable by changing tension therein by a player of the instrument comprising:

providing a source of stroboscopic light;

locating the source relative to the string such that rays of light from the source shine past the string into the eyes of the player such that some of said rays are eclipsed by the string;

driving said stroboscopic light source at a frequency equal to a required frequency of vibration of the string;

observing movement of a shadow on the light source caused by a difference in frequency between an actual frequency of the string and the required frequency;

and changing tension in the string so as to slow the movement of the shadow to cause tuning of the string to the required frequency;

the source comprising a plurality of stroboscopic light sources in a row along the string wherein the light sources are driven with the same frequency at different phase.

19. A method of tuning a musical instrument having a plurality of strings each tunable by changing tension therein by a player of the instrument comprising:

providing a plurality of sources of stroboscopic light each associated with a respective one of the strings;

locating each source relative to the respective string such that rays of light from the source shine past the string into the eyes of the player such that some of said rays are eclipsed by the string, driving said stroboscopic light sources each at a frequency equal to a required frequency of vibration of the respective string;

observing movement of a shadow on the light source caused by a difference in frequency between an actual frequency of the string and the required frequency;

and changing tension in the string so as to slow the movement of the shadow to cause tuning of the string to the required frequency;

wherein the light sources are mounted on a common support in fixed position thereon such that the common support can be located on the instrument for location of the light sources behind the strings at required positions relative to the respective strings.

20. A method of tuning a musical instrument having at least one string tunable by changing tension therein by a player of the instrument comprising:

providing a source of stroboscopic light;

locating the source relative to the string such that rays of light from the source shine past the string into the eyes of the player such that some of said rays are eclipsed by the string, driving said stroboscopic light source at a frequency equal to a required frequency of vibration of the string;

observing movement of a shadow on the light source caused by a difference in frequency between an actual frequency of the string and the required frequency;

and changing tension in the string so as to slow the movement of the shadow to cause tuning of the string to the required frequency;

wherein the light source is mounted at a position offset to one side of a position symmetrically beneath the string so as to be viewed from a playing position offset to one side of the string.

* * * * *